US007557496B2

(12) United States Patent
Kato

(10) Patent No.: US 7,557,496 B2
(45) Date of Patent: Jul. 7, 2009

(54) SPARK PLUG WHICH CAN PREVENT LATERAL SPARKING

(75) Inventor: Tomoaki Kato, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 122 days.

(21) Appl. No.: 11/368,629

(22) Filed: Mar. 7, 2006

(65) Prior Publication Data

US 2006/0202599 A1 Sep. 14, 2006

(30) Foreign Application Priority Data

Mar. 8, 2005 (JP) ..... P.2005-063747

(51) Int. Cl.
*H01T 13/46* (2006.01)
*H01T 13/20* (2006.01)

(52) U.S. Cl. ..... 313/143; 313/141; 313/142; 313/112

(58) Field of Classification Search ..... 313/135, 313/140–157
See application file for complete search history.

(56) References Cited

U.S. PATENT DOCUMENTS

| | | | | |
|---|---|---|---|---|
| 3,870,918 | A * | 3/1975 | Senda et al. | 313/131 R |
| 5,693,999 | A * | 12/1997 | Osamura et al. | 313/141 |
| 5,929,556 | A * | 7/1999 | Matsubara et al. | 313/141 |
| 6,064,143 | A * | 5/2000 | Kagawa | 313/141 |
| 6,091,185 | A * | 7/2000 | Matsubara et al. | 313/138 |
| 6,166,480 | A | 12/2000 | Ishida et al. | |
| 6,680,561 | B2 * | 1/2004 | Yamaguchi et al. | 313/118 |
| 7,077,100 | B2 | 7/2006 | Vogel et al. | |
| 2002/0094743 | A1 * | 7/2002 | Harada | 445/7 |
| 2003/0062815 | A1 * | 4/2003 | Kanao et al. | 313/141 |
| 2004/0080252 | A1 * | 4/2004 | Ito et al. | 313/141 |
| 2004/0115976 | A1 | 6/2004 | Morita et al. | |
| 2005/0093415 | A1 * | 5/2005 | Suzuki | 313/141 |
| 2005/0264151 | A1 * | 12/2005 | Mori et al. | 313/141 |

FOREIGN PATENT DOCUMENTS

| | | |
|---|---|---|
| DE | 102 14 167 A1 | 10/2003 |
| EP | 1 601 073 A1 | 11/2005 |
| JP | 9-256939 | 9/1997 |
| JP | 2004-207219 | 7/2004 |

OTHER PUBLICATIONS

Kazuhiro et al., Japanese Patent 09-256939, Sep. 1997, machine translation.*
Chinese Office Action Jul. 25, 2008.

* cited by examiner

*Primary Examiner*—Sikha Roy
*Assistant Examiner*—Tracie Y Green
(74) *Attorney, Agent, or Firm*—Sughrue Mion, PLLC

(57) ABSTRACT

A spark plug including: a center electrode (20); an insulator (10) having an axial hole (12) extending in an axial direction of the center electrode (20) and holding the center electrode (20) in the axial hole (12); a cylindrical metal shell (50) surrounding the insulator (10) and holding the insulator (10); and a ground electrode (30) having first and second end portions, an end face (35) of one end portion (32) being joined to a tip face (57) of the metal shell (50) and which is bent so that the other end portion (31) is opposed to the center electrode (20). An axial line (P) of the metal shell (50) and an axial line (O) of the insulator (10) deviate from one another so that a relationship A>B is satisfied for distances A and B as defined herein.

6 Claims, 12 Drawing Sheets

SPARK PLUG WHICH CAN PREVENT LATERAL SPARKING

BACKGROUND OF THE INVENTION

1. Field of the Invention

The present invention relates to a spark plug for an internal combustion engine which can prevent lateral sparking.

2. Description of the Related Art

Conventionally, a spark plug for ignition is used in an internal combustion engine. In the spark plug, in general, a ground electrode is welded to a combustion-chamber-side tip portion of a metal shell which holds an insulator in which a center electrode is inserted. The other end portion of the ground electrode is opposed to the tip face of a tip portion of the center electrode, whereby a spark discharge gap is formed. When a spark discharge is caused between the center electrode and the ground electrode, an air-fuel mixture between the two electrodes is ignited and a flame nucleus is formed (refer to JP-A-2004-207219, for example).

If a rich air-fuel mixture is introduced continuously to the cylinder during operation of an internal combustion engine or if the internal combustion engine operates at low speeds over a long period of time, smoldering (smoldering pollution) where carbon adheres to an insulator surface around the tip portion of the center electrode may occur due to insufficient atomization of the fuel, temperature reduction of the insulator, or another reason. In the event of smoldering, current flows via the carbon adhered to the insulator surface, which may cause lateral sparking between the insulator surface and the inner circumferential surface of the metal shell. An effective measure against lateral sparking is to determine the clearance between the outer circumferential surface of the insulator and the inner circumferential surface of the metal shell and the length of the spark discharge gap so that a spark discharge occurs at the spark discharge gap even in the event of smoldering.

However, in recent years, the output power and fuel efficiency of automobile engines have increased and miniaturization of spark plugs has come to be required in order to secure a high degree of freedom in engine-side designing. Accordingly, the clearance between the outer circumferential surface of the insulator and the inner circumferential surface of the metal shell has been decreased, such that lateral sparking tends to occur at lower voltage differences than before. In particular, since the electric field strength is high around the ground electrode which projects from the tip face of the metal shell, spark plugs in which the dimensions of individual parts are merely scaled down from those of older versions are problematic in that a spark discharge tends to occur from the outer circumferential surface of the insulator to a ground-electrode-side portion of the inner circumferential surface of the metal shell in the event of smoldering.

SUMMARY OF THE INVENTION

The present invention has been made to solve the above problems, and therefore an object of the invention is to provide a spark plug which is capable of preventing lateral sparking, by arranging the inner circumferential surface of a metal shell and the outer circumferential surface of an insulator so as to assume eccentric circles in sectional view.

More particularly, the above object has been achieved by providing a spark plug, according to a first aspect of the invention, comprising a center electrode, an insulator which has an axial hole extending in an axial direction of the center electrode and holding the center electrode in the axial hole, a cylindrical metal shell surrounding the insulator, and a ground electrode having first and second end portions, an end face of one end portion being joined to a tip face of the metal shell and the other end portion being opposed to the center electrode. The spark plug is characterized in that an axial line of the metal shell and an axial line of the insulator deviate from one another so that a relationship A>B is satisfied for distances A and B which are defined on a line connecting the center of an inner circle of the tip face of the metal shell and the center of the end face of the one end portion of the ground electrode. The distance A is defined as a distance on the side of the ground electrode between the inner circle of the tip face of the metal shell and an intersection line of an outer circumferential surface of the insulator and a plane including the tip face of the metal shell or a projection, onto the plane, of an intersection line of an extended surface of the outer circumferential surface of the insulator and a plane including a tip face of the insulator. The distance B is defined as a distance on a side opposite the ground electrode between the inner circle of the tip face of the metal shell and the intersection line of the outer circumferential surface of the insulator and the plane including the tip face of the metal shell or the projection, onto the plane, of the intersection line of the extended surface of the outer circumferential surface of the insulator and the plane including the tip face of the insulator.

The spark plug according to a second aspect of the invention is characterized in that, in the configuration of the first aspect, the metal shell has, as an outer circumferential portion, a screw portion having a nominal diameter which is smaller than or equal to that of M12; and the axial line of the metal shell and the axial line of the insulator deviate from one another so that a relationship $0.1\ \text{mm} \leqq A-B \leqq 0.3\ \text{mm}$ is satisfied.

The spark plug according to a third aspect of the invention is such that, in the configuration of the first aspect, a distance between the inner circle of the tip face of the metal shell and the intersection line of the outer circumferential surface of the insulator and the plane including the tip face of the metal shell or the projection, onto the plane, of the intersection line of the extended surface of the outer circumferential surface of the insulator and the plane including the tip face of the insulator is shorter than or equal to 1.5 mm, and is characterized in that the axial line of the metal shell and the axial line of the insulator deviate from one another so that a relationship $0.1\ \text{mm} \leqq A-B \leqq 0.3\ \text{mm}$ is satisfied.

The spark plug according to a fourth aspect of the invention is characterized in that, in the configuration of any one of the first to third aspects, a C-chamfered portion of C0.1 or larger or an R-chamfered portion of R0.1 or larger is formed at a ridge line defined by the tip face and an inner circumferential surface of the, metal shell. The term "C-chamfered portion" means a chamfered portion in which the corner defined by two planes is chamfered so that the angles between the chamfer plane and the two planes defining the corner are about 45° respectively. The term "C0.1 or larger" means that the cut lengths of the two planes cut by the chamfer are 0.1 mm or longer, respectively. The term "R-chamfered portion" means a chamfered portion in which the corner defined by two planes is chamfered so that a circular arc having a curvature radius of R is formed at the chamfer. The term "R0.1 or larger" means that the curvature radius R is 0.1 mm or longer.

The spark plug according to a fifth aspect of the invention is characterized in that, in the configuration of any one of the first to fourth aspects, the ground electrode is joined to the tip face of the metal shell by welding and a length of projection, toward the center of the inner circle of the tip face of the metal shell, of a welding projection formed by the welding so as to bridge the ground electrode and the metal shell is made shorter than or equal to 0.1 mm.

The spark plug according to a sixth aspect of the invention is characterized in that, in the configuration of any one of the first to fifth aspects, an intersection point of the axial line of the insulator and the plane including the tip face of the metal shell is located in an acute-angled sector located on the side opposite the ground electrode of acute-angled sectors which are defined by parts of the inner circle of the tip face of the metal shell and two straight lines passing through two respective inside corners of the end face of the one end portion of the ground electrode and the center of the inner circle of the tip face of the metal shell.

In the spark plug according to the first aspect of the invention, the axial line of the metal shell and the axial line of the insulator deviate from one another so that the ground-electrode-side distance A between the inner circle of the tip face of the metal shell and the outer circumferential surface of the insulator is longer than the distance B, on the side opposite the ground electrode, between the inner circle of the tip face of the metal shell and the outer circumferential surface of the insulator. The ground electrode is joined to a part of the tip face of the metal shell, and the electric field strength around the ground electrode increases at the time of spark discharge. Therefore, when the spark plug is polluted and rendered in a smoldered state, lateral sparking to the ground electrode tends to occur. However, according to the invention, since the axial line of the metal shell and the axial line of the insulator deviate from one another, the insulator is set away from the ground electrode in the region concerned. Hence, lateral sparking can be prevented even when the spark plug is rendered in a smoldered state.

In small spark plugs in which the nominal diameter of the screw portion is smaller than or equal to that of M12, it is difficult to secure sufficient clearance between the inner circumferential surface of the metal shell and the outer circumferential surface of the insulator. That is, it is difficult to secure sufficient clearance to prevent lateral sparking as mentioned above from occurring between the ground electrode and the insulator. Where the axial line of the metal shell and the axial line of the insulator deviate from one another according to the second aspect of the invention and the insulator is thereby set away from the ground electrode in the region concerned, lateral sparking can be prevented even when the spark plug is rendered in a smoldered state. However, if the insulator comes close to that portion of the inner circumferential surface of the metal shell which is located on the side opposite the side where the ground electrode is joined to the metal shell, lateral sparking may occur between that portion of the inner circumferential surface and the outer circumferential surface of the insulator. Lateral sparking can be effectively prevented by establishing the relationship $0.1\ \text{mm} < A - B < 0.3\ \text{mm}$ for the distances A and B.

In small spark plugs in which the distance between the inner circle of the tip face of the metal shell and the intersection line of the outer circumferential surface of the insulator and the plane including the tip face of the metal shell or the projection, onto the plane, of the intersection line of the extended surface of the outer circumferential surface of the insulator and the plane including the tip face of the insulator is shorter than or equal to 1.5 mm, it is difficult to secure sufficient clearance between the inner circumferential surface of the metal shell and the outer circumferential surface of the insulator. Therefore, establishing the relationship $0.1\ \text{mm} \leqq A - B \leqq 0.3\ \text{mm}$ for the distances A and B according to the third aspect of the invention is effective in preventing lateral sparking.

Where the ridge line defined by the tip face and the inner circumferential surface of the metal shell is chamfered as in the spark plug according to the fourth aspect of the invention, electric field concentration around the ridge line can be prevented and the probability of the occurrence of lateral sparking can thereby be reduced. Since the chamfered portion is a C-chamfered portion of C0.1 or larger or an R-chamfered portion of R0.1 or larger, the tip face of the metal shell can be set away from the inner circumferential surface of the metal shell by interposing the chamfered portion, leading to a preferable result in that electric field concentration can be prevented more reliably.

A welding projection is formed so as to bridge the metal shell and the ground electrode when they are joined by welding. By making the length of projection, toward the center of the inner circle of the tip face of the metal shell, of the welding projection shorter than or equal to 0.1 mm according to the above fifth aspect, the invention is more effective in preventing lateral sparking. If the length of the welding projection is greater than 0.1 mm, a bridge may be formed by carbon, cinders, etc., produced by combustion because the absolute distance between the metal shell and the insulator is small, although electric field strengths remain balanced. When the welding projection is made shorter than or equal to 0.1 mm, this problem can be avoided and assembly in a manufacturing process can be facilitated. The manufacturing yield of the spark plug can thus be increased.

The ground electrode is joined to the tip face of the metal shell with its one side surface opposed to-the axial line of the metal shell. Ridge lines are formed by the one side surface and the adjacent side surfaces, and electric field concentration tends to occur there. In the plane including the tip face of the metal shell, two straight lines are assumed which pass through the center of the inner circle of the tip face of the metal shell and the two inside corners of the end face of the ground electrode. The region inside the inner circle of the tip face of the metal shell is divided into four regions by the two straight lines. The intersection point of the axial line of the insulator and the plane including the tip face of the metal shell is located in the acute-angled sector located on the side opposite the ground electrode among the four regions. That is, according to the sixth aspect of the invention, the positional relationship between the axial line of the metal shell and the axial line of the insulator are defined so that the axial line of the insulator passes through this acute-angled sector.

The "two inside corners of the end face of the ground electrode" are the two end points of the inside line segment closest to the axial line of the metal shell among the four line segments that form the outline of the end face of the one end portion of the ground electrode in the plane including the tip face of the metal shell. The inside end points are points obtained by projecting, onto the plane including the tip face of the metal shell, the two ridge lines of the ground electrode located on the side of the axial line of the metal shell.

The electric field strength around the ground electrode increases and the electric field becomes more apt to concentrate particularly around the two inside end points as the axial line of the insulator comes closer to the ground electrode on the straight line connecting the center of the inner circle of the tip face of the metal shell and the center of the end face of the one end portion of the ground electrode. When the position of the axial line of the insulator is moved in the direction perpendicular to the straight line connecting the center of the inner circle of the tip face of the metal shell and the center of the end face of the one end portion of the ground electrode on the side where the position of the axial line of the insulator is close to the ground electrode in the region that is located inside the inner circle of the tip face of the metal shell and in which the relationship A>B is satisfied, there is a difference in the distances between the position of the axial line of the insulator and the two inside end points. Also, the electric field concentration around the closer one of the inside end points becomes more influential. Therefore, the influence of the electric field concentration around the closer inside end point can be decreased as the position of the axial line of the insulator comes closer to the position where the distances between the position of the axial line of the insulator and the two inside end points are the same.

On the other hand, the difference in the distances between the position of the axial line of the insulator and the two inside end points does not vary to a large extent. Hence, the influence of the electric field concentration around the inside end points is not influential, even if the position of the axial line of the insulator is moved in the direction perpendicular to the straight line connecting the center of the inner circle of the tip face of the metal shell and the center of the end face of the one end portion of the ground electrode on the side where the position of the axial line of the insulator is distant from the ground electrode in the region that is located inside the inner circle of the tip face of the metal shell and in which the relationship A>B is satisfied. However, a state where the position of the axial line of the insulator deviates so as to be located outside the range whose length is equal to the distance between the two inside end points is not preferable. This is because the distance between the metal shell and the insulator is small on the side of the deviation.

Based on the above discussion, when the position of the axial line of the insulator is located in the above mentioned acute-angled sector according to the sixth aspect of the invention, on the side where the position of the axial line of the insulator is close to the ground electrode in the region that is located inside the inner circle of the tip face of the metal shell and in which the relationship A>B is satisfied, the position of the axial line of the insulator can be set close to the position where the distances between the position of the axial line of the insulator and the two inside end points are the same. On the side, in the above region, where the position of the axial line of the insulator is distant from the ground electrode, the influence of the electric field concentration around the inside end points can be made small even if the position of the axial line of the insulator is moved in the above-mentioned manner. As a result, the probability of lateral sparking can be made sufficiently low even if the allowance of the positioning between the metal shell and the insulator in manufacture of the spark plug is set large.

In manufactured spark plugs, because a melted portion is formed by welding the tip face of the metal shell and the end face of the one end portion of the ground electrode, the inside end points may not be clearly found. In such a case, the two inside end points of the ground electrode may be determined by using a projection obtained by projecting, onto the plane including the tip face of the metal shell, a portion of the ground electrode that has clear inside end points in a transverse cross section. More specifically, a projection may be used which is obtained by projecting, onto the above plane, inside end points in a portion located on the tip side of a melted portion between the metal shell and the ground electrode (e.g., an imaginary cross section of the ground electrode that is set apart from the tip face of the metal shell by 1 mm).

Figure 1:
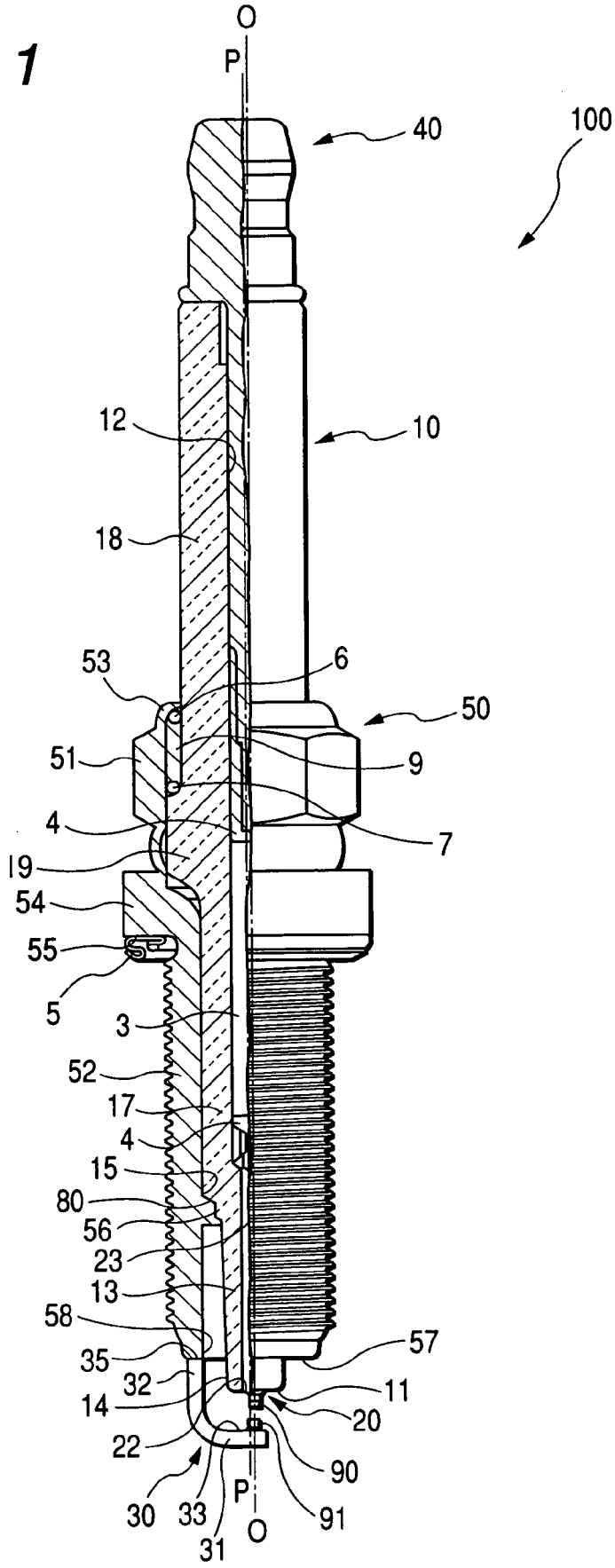
FIG. 1 is a partial sectional view of a spark plug 100.

Reference numerals used to identify various structural elements in the drawings include the following.

10: Insulator
12: Axial hole
14: Outer circumferential surface
20: Center electrode
30: Ground electrode
31: Tip portion
32: Base portion
50: Metal shell
52: Screw portion
57: Tip face
59: Ridge line
85: Welding projection
100: Spark plug
459: C-chamfered portion
469: R-chamfered portion

DETAILED DESCRIPTION OF THE INVENTION

A spark plug according to an embodiment of the present invention will hereinafter be described with reference to the drawings. However, the present invention should not be construed as being limited thereto.

Figure 2:
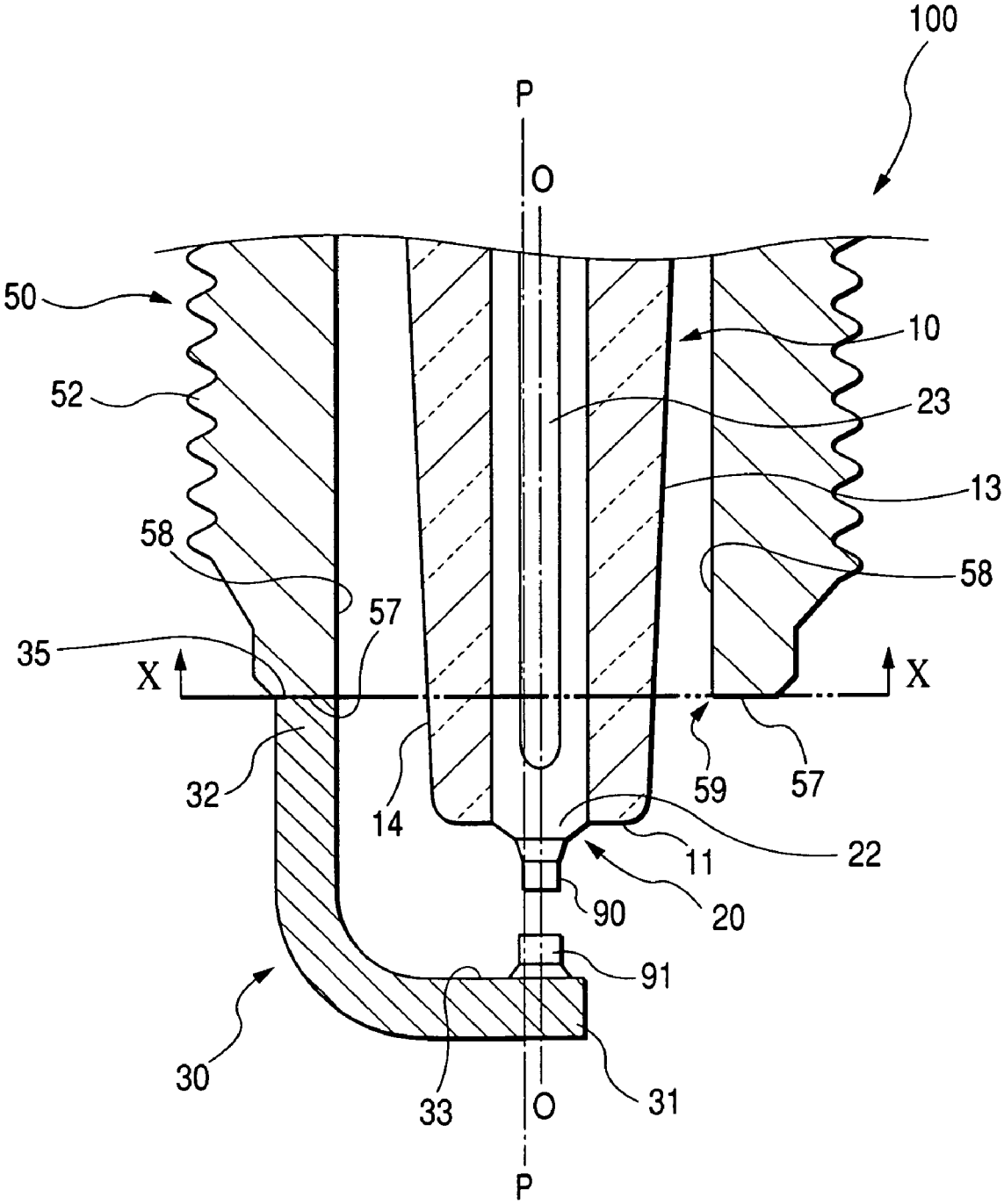
FIG. 2 is an enlarged sectional view of part of the spark plug 100.

First, the entire structure of an exemplary spark plug 100 will be described with reference to FIGS. 1 and 2. FIG. 1 is a partial sectional view of the spark plug 100. FIG. 2 is an enlarged sectional view of part of the spark plug 100 of particular interest. In the spark plug 100 according to the embodiment, to prevent lateral sparking, a metal shell 50 and an insulator 10 are assembled in such manner that their axial lines deviate from one another. In the following description, the axial lines of the insulator 10 and the metal shell 50 are indicated by chain lines O and P, respectively. Further, in the drawings, the axial line O will be set in the top/bottom direction and the tip side and the tail side (rear end side) of the spark plug 100 will be set below and above, respectively.

As shown in FIG. 1, the spark plug 100 is generally composed of the insulator 10, the metal shell 50 which holds the insulator 10, a center electrode 20 which is held in the insulator 10 so as to extend along the axial line O, a ground electrode 30 having an end face 35 on the side of its base portion 32 welded to a tip face 57 of the metal shell 50 and having a side surface on the side of its tip portion 31 opposed to a tip portion 22 of the center electrode 20, and a terminal metal part 40 which is disposed in the rear of the insulator 10.

First, the insulator 10 of the spark plug 100 will be described. As known in this field of art, the insulator 10 is a cylindrical insulating member which is formed by sintering alumina or the like and has an axial hole 12 extending along the axial line O. A brim portion 19 having a largest outer diameter is formed approximately at the center in the axial line O direction, and a tail-side barrel portion 18 is formed in the rear of the brim portion 19. A tip-side barrel portion 17 which is smaller in diameter than the tail-side barrel portion 18 is formed on the tip side of the brim portion 19, and a leg portion 13 which is even smaller in diameter than the tip-side barrel portion 17 is formed on the tip side of the tip-side barrel portion 17. The leg portion 13 is tapered toward the tip, and is placed in the combustion chamber when the spark plug 100 is mounted to an internal combustion engine (not shown). A step portion 15 is formed between the leg portion 13 and the tip-side barrel portion 17.

The center electrode 20 is made of, for example, a nickel alloy such as INCONEL (trade name) 600 or 601 and has an embedded metal core 23 made of copper or the like having high heat conductivity. The center electrode 20 is held in the axial hole 12 of the insulator 10 so as to occupy its tip-side space, and the tip portion 22 of the center electrode 20 projects from the tip face 11 of the insulator 10 and tapers down toward the tip. As shown in FIG. 2, a column-shaped noble metal chip 90 is welded to the tip face of the tip portion 22 in such manner that its column axis coincides with the axial line of the center electrode 20. As shown in FIG. 1, the center electrode 20 is electrically connected to the terminal metal part 40 (located at the tail) via a sealing body 4 and a ceramic resistor 3 which are disposed inside the axial hole 12. A high-voltage cable (not shown) is connected to the terminal metal part 40 via a plug cap (not shown), whereby a high voltage is applied to the terminal metal part 40.

Next, the ground electrode 30 will be described. As shown in FIG. 2, the ground electrode 30 is made of a metal of high corrosion resistance, an example of which is a nickel alloy such as INCONEL (trade name) 600 or 601. The ground electrode 30 is approximately rectangular in transverse cross section, and its one end face 35 on the side of base portion 32 is joined to the tip face 57 of the metal shell 50 by welding. The ground electrode 30 is bent so that part of an inside surface 33 corresponding to the other end portion (tip portion 31) of the ground electrode 30 is opposed to the tip portion 22 of the center electrode 20. A noble metal chip 91 is joined to the inside surface 33 of the tip portion 31 in such manner that its axis coincides with the axis of the center electrode 20. As a result, a spark discharge gap is formed between the noble metal chips 90 and 91 which are opposed to one another.

Next, the metal shell 50 will be described. As shown in FIG. 1, the metal shell 50 is a cylindrical metal part for fixing the spark plug 100 to the engine head of an internal combustion engine (not shown) and holds the insulator 10 so as to surround it. A tip portion of the leg portion 13 of the insulator 10 projects forward (downward in FIG. 1) from the tip face 57 of the metal shell 50. The metal shell 50 is made of an iron-based material, and is provided with a tool engagement portion 51 to be fitted with a spark plug wrench (not shown) and a screw portion 52 to be threadedly engaged with the engine head which is provided at the top of an internal combustion engine (not shown).

Annular ring members 6 and 7 are interposed between the tool engagement portion 51 of the metal shell 50 and the tail-side barrel portion 18 of the insulator 10, and the space between the two rings 6 and 7 is charged with talc powder 9. A crimping portion 53 is formed in the rear of the tool engagement portion 51. The insulator 10 is pressed toward the tip side in the metal shell 50 via the ring members 6 and 7 and the talc powder 9 by crimping the crimping portion 53. As a result, the step portion 15 of the insulator 10 between the tip-side barrel portion 17 and the leg portion 13 is supported, via a packing 80, by a step portion 56 which is formed in the inner circumferential surface of the metal shell 50, whereby the metal shell 50 and the insulator 10 are integrated with one another. Airtightness between the metal shell 50 and the insulator 10 is secured by the packing 80 to prevent an outflow of combustion gas. A brim portion 54 is formed at a central position of the metal shell 50, and a gasket 5 is inserted so as to be located in the rear of (in FIG. 5, over) the screw portion 52, that is, on a seat face 55 of the brim portion 54.

For example, in spark plugs in which the nominal diameter of the metal shell is larger than M12, lateral sparking is not prone to occur due to an increase in the strength of an electric field around the ground electrode. This is because the distance (clearance) between the outer circumferential surface (14) of the insulator 10 and the inner circumferential surface (58) of the metal shell is sufficiently long and the insulation resistance is large there. In view of this, the embodiment is directed to spark plugs (100) in which the nominal diameter of the screw portion (52) as a measure of the spark plug size is smaller than or equal to M12. In such spark plugs, the above-mentioned clearance is smaller than or equal to 1.5 mm, and hence dielectric breakdown tends to occur there at a smaller resistance value than in spark plugs in which the nominal diameter of the screw portion is larger than M12. In the spark plug 100, disposing the outer circumferential surface 14 of the insulator 10 away from the ground electrode 30 around which the electric field strength becomes high at the time of a spark discharge is effective in preventing lateral sparking between the outer circumferential surface 14 of the insulator 10 and the inner circumferential surface 58 of the metal shell 50 at a position close to the ground electrode 30 when smoldering has occurred. Therefore, in the spark plug 100 according to the embodiment, in one step of its manufacture, the metal shell 50 and the insulator 10 are integrated by crimping in a state that the axial line P of the metal shell 50 and the axial line O of the insulator 10 deviate from one another.

Figure 3:
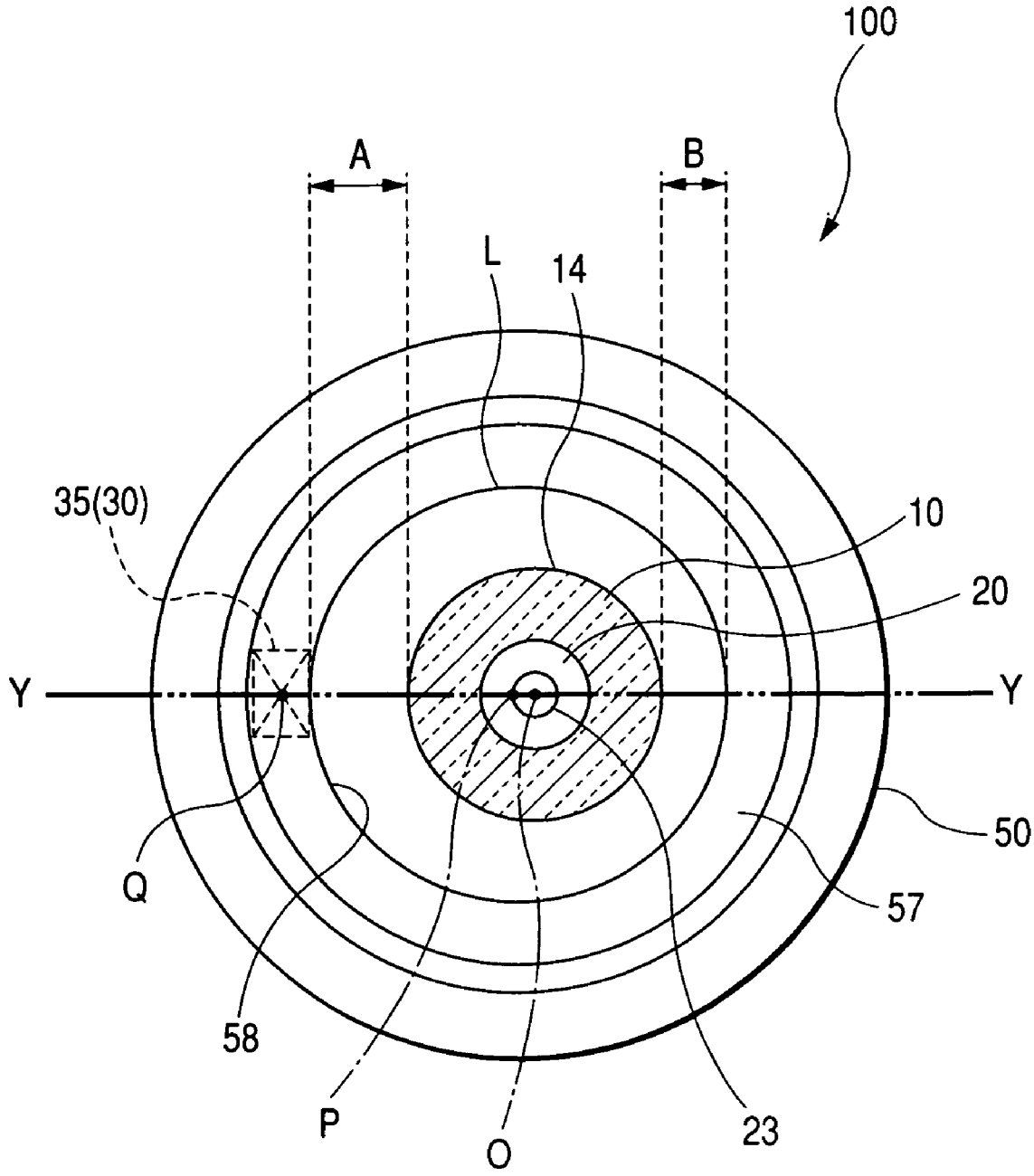
FIG. 3 is a sectional view of a tip portion of the spark plug 100 taken along a two-dot chain line X-X in FIG. 2 and viewed from the direction indicated by the arrows.
Figure 4:
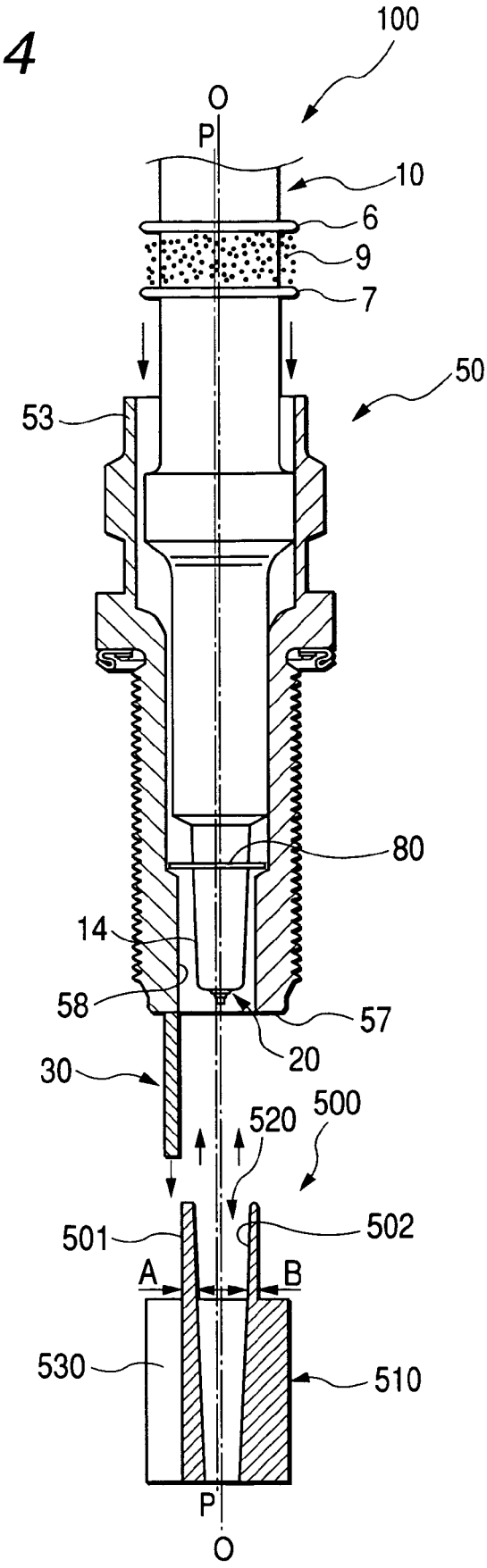
FIG. 4 illustrates a technique for fixing a metal shell 50 to an insulator 10 in an off-axis state.
Figure 5:
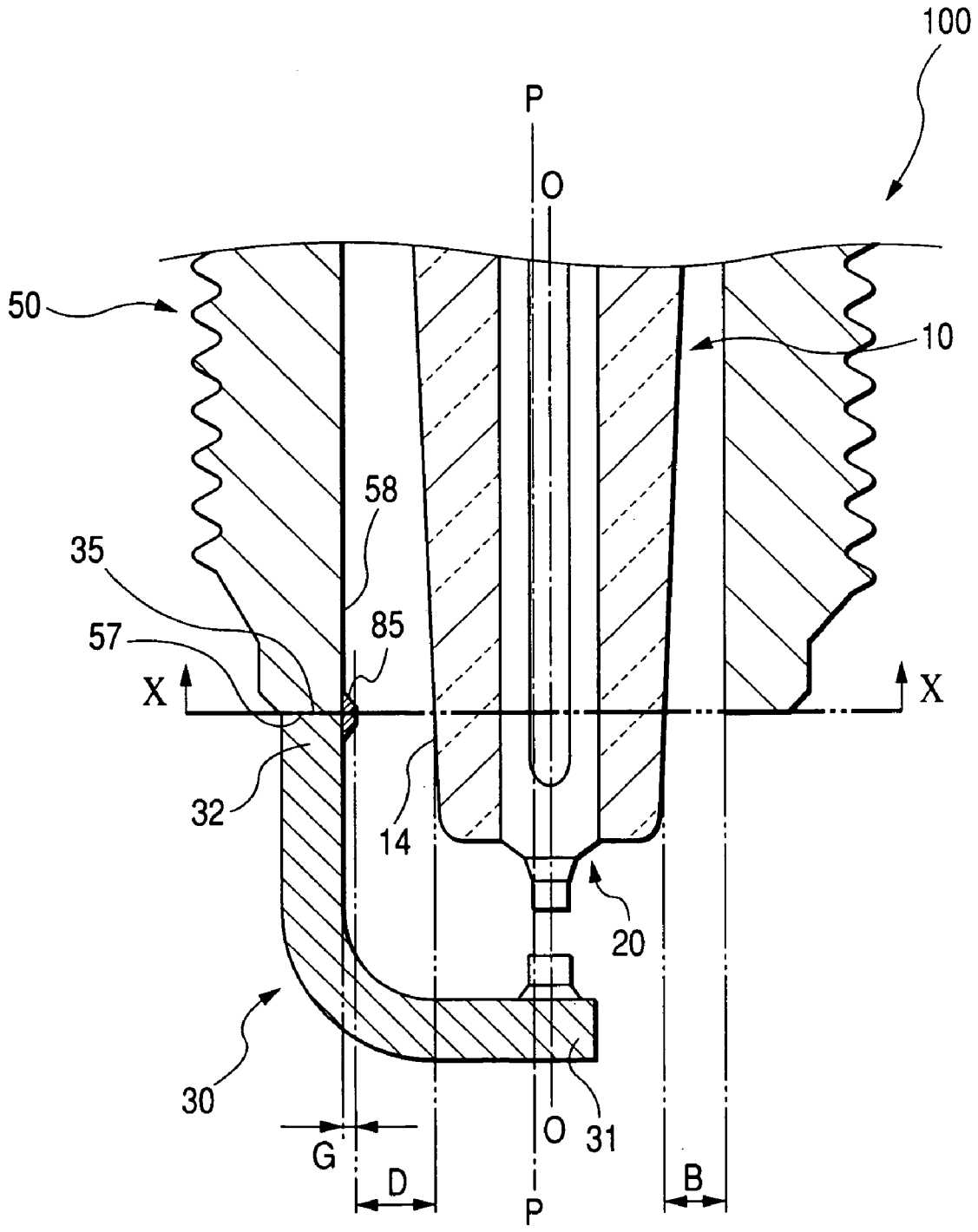
FIG. 5 is an enlarged sectional view of part of the spark plug 100 in which a welding burr bridging a metal shall 50 and a ground electrode 30 is not completely removed.
Figure 6:
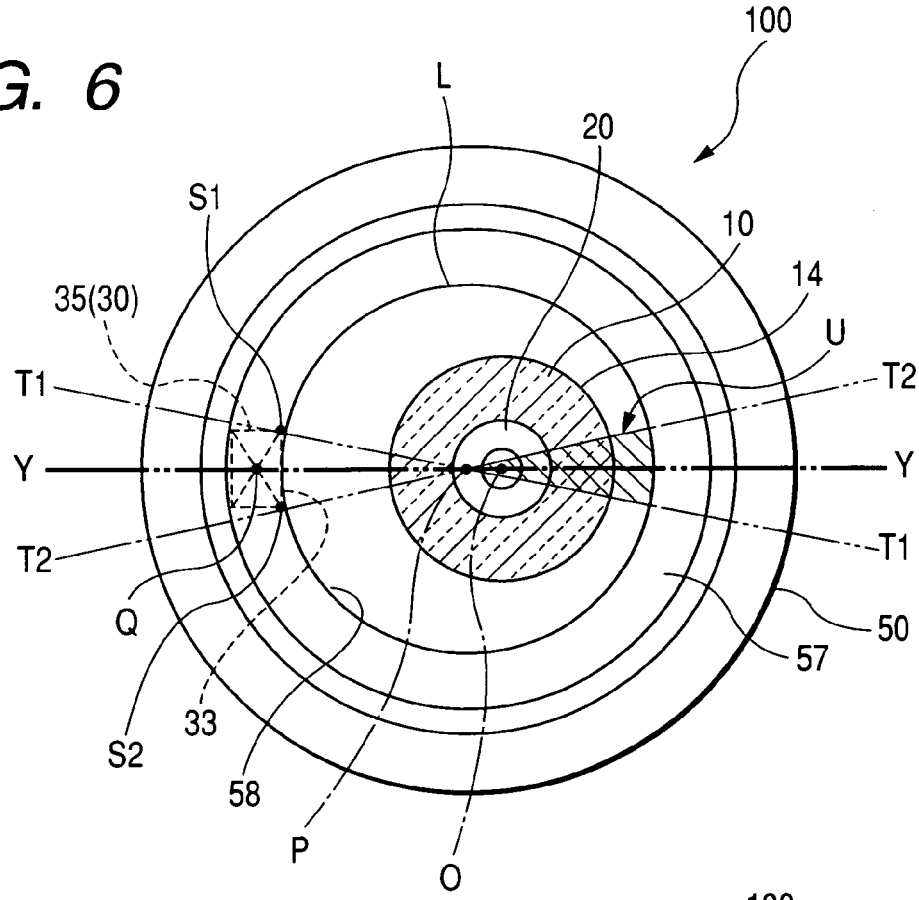
FIG. 6 is a sectional view of the tip portion of the spark plug 100, illustrating a preferred positional relationship between the axial line O of the insulator 10 and inside end points S1 and S2 of a ground electrode 30.
Figure 7:
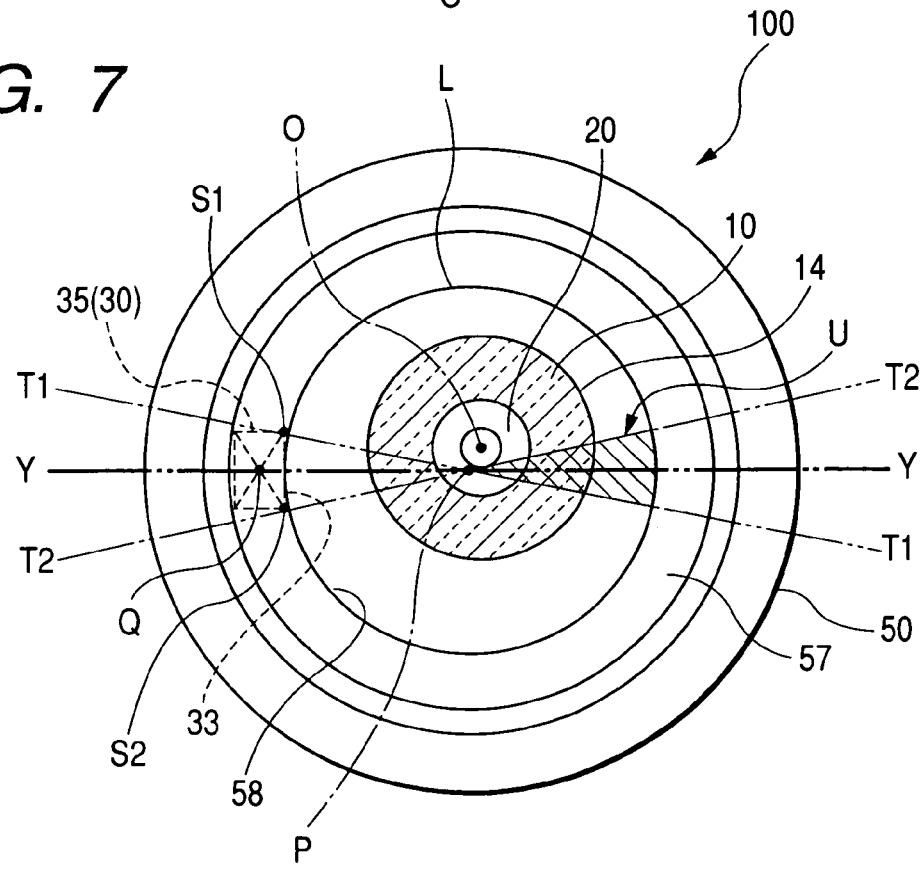
FIG. 7 is a sectional view of the tip portion of the spark plug 100, illustrating a positional relationship between the axial line O of the insulator 10 and the inside end points S1 and S2 of the ground electrode 30 which is not preferred.
Figure 8:
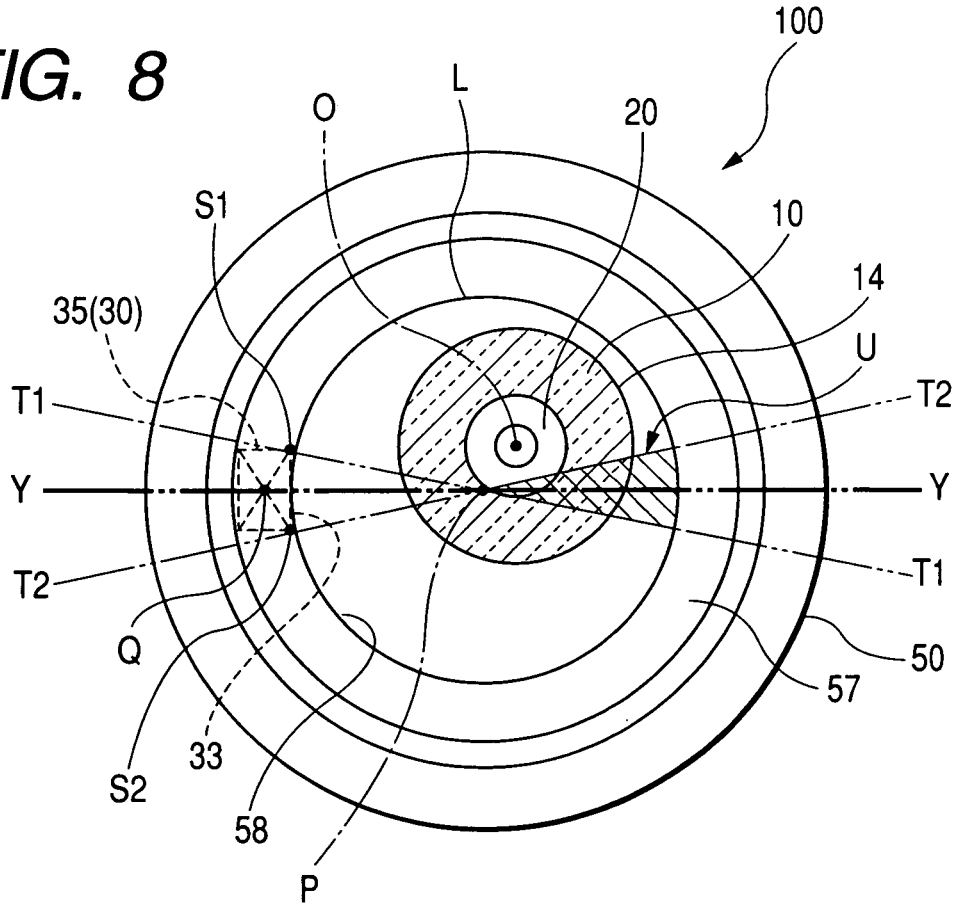
FIG. 8 is a sectional view of the tip portion of the spark plug 100, illustrating another positional relationship between the axial line O of the insulator 10 and the inside end points S1 and S2 of the ground electrode 30 which is not preferred.

The relative positional relationship between the metal shell 50 and the insulator 10 will be described below with reference to FIGS. 2-8. FIG. 3 is a sectional view of a tip portion of the spark plug 100 taken along a two-dot chain line X-X in FIG. 2 and viewed from the direction indicated by the arrows. FIG. 4 illustrates a technique of fixing the metal shell 50 and the insulator 10 to one another in an off-axis state. FIG. 5 is an enlarged sectional view of a part of the spark plug 100 in which a welding burr bridging the metal shall 50 and the ground electrode 30 is not completely removed. FIG. 6 is a sectional view of the tip portion of the spark plug 100, illustrating a preferred positional relationship between the axial line O of the insulator 10 and inside end points S1 and S2 of the ground electrode 30. FIG. 7 is a sectional view of the tip portion of the spark plug 100, illustrating a positional relationship between the axial line O of the insulator 10 and the inside end points S1 and S2 of the ground electrode 30 that is not preferred. FIG. 8 is a sectional view of the tip portion of the spark plug 100, illustrating a second positional relationship between the axial line O of the insulator 10 and the inside end points S1 and S2 of the ground electrode 30 that is not preferred.

As shown in FIG. 2, in the cross section of the spark plug 100 including the axial line P of the metal shell 50 and the axial line O of the insulator 10, the axial line O of the insulator 10 deviates from the axial line P of the metal shell 50 to the side opposite to the side where the ground electrode 30 is joined to the metal shell 50. More specifically, the following positional relationship is established. First, as shown in FIG. 3, Q denotes the center of the base-portion-30-side end face 35 of the ground electrode 30 which is joined to the tip face 57 of the metal shell 50. In this embodiment, since the transverse cross section of the ground electrode 30, that is, the end face 35, is approximately rectangular, the intersection point of the diagonals of the rectangle is denoted by Q. Since as mentioned above the ground electrode 30 is welded to the metal shell 50, a melted portion is formed in the welding region and hence the shape of the end face 35 of the ground electrode 30 may not be clearly defined. In such a case, the center Q of the end face 35 of the ground electrode 30 may be determined by projecting that portion of the ground electrode 30 which has a clear sectional shape onto a plane including the tip face 57 of the metal shell 50 (i.e., an X-X plane including the cross section of the spark plug 100 taken along the two-dot chain line X-X in FIG. 2 and viewed from the direction indicated by the arrows).

If the metal shell 50 is not eccentric in the X-X plane, the center of the inner circle (denoted by L in FIG. 3) of the tip face 57 of the metal shell 50 coincides with the intersection point of the axial line P and the X-X plane. Therefore, the line passing through the center Q and the axial line P in the X-X plane is denoted by Y-Y. The distance between the outer circumferential surface 14 of the insulator 10 and the inner circle L of the tip face 57 of the metal shell 50 on the line Y-Y on the ground electrode 30 side of the axial line P is represented by A. The distance between the outer circumferential surface 14 of the insulator 10 and the inner circle L of the tip face 57 of the metal shell 50 on the line Y-Y on the side of the axial line P opposite to the ground electrode 30 is represented by B. In the spark plug 100 according to the embodiment, the positional relationship between the inner circumferential surface 58 of the metal shell 50 and the outer circumferential surface 14 of the insulator 10 is determined so as to satisfy a relationship A>B.

Usually, from the viewpoint of increasing its insulation performance, heat resistance, and durability, the insulator 10 is formed so that its cross section perpendicular to the axial line O assumes a perfect circle. Likewise, usually, the metal shell 50 is formed so that its cross section perpendicular to the axial line P assumes a perfect circle. Therefore, in a manufacturing process of the spark plug 100, it is appropriate to crimp the crimping portion 53 in a state that the metal shell 50 and the insulator 10 are tentatively fixed to one another after being positioned with respect to one another so that the position of the axial line O is located on the side of the position of the axial line P opposite the ground electrode 40 on the line Y-Y. The above-mentioned relationship A>B can be satisfied by the above procedure, that is, by positioning the metal shell 50 and the insulator 10 with respect to one another using the axial lines P and O as references.

As shown in FIG. 4, one specific method for positioning the metal shell 50 and the insulator 10 at the time of crimping is a method using a positioning member 500. The positioning member 500 is cylindrical and has a through-hole 520. An outer circumferential surface 501 engages the inner circumferential surface 58 of the metal shell 50, and an inner circumferential surface 502 of the through-hole 520 engages the outer circumferential surface 14 of the insulator 10. The positioning member 500 is configured so that the positional relationship between the axis of the cylindrical shape of the outer circumferential surface 501 and the axis of the cylindrical shape of the inner circumferential surface 502 is the same as that of the axial line P of the crimped metal shell 50 and the axial line O of the insulator 10. That is, the axis of the cylindrical shape of the outer circumferential surface 501 and the axis of the cylindrical shape of the inner circumferential surface 502 deviate from one another so that the wall defined by the outer circumferential surface 501 and the inner circumferential surface 502 of the positioning member 500 has portions whose thicknesses in the vertical sectional view satisfy the relationship A>B which was described above with reference to FIG. 3. So that the positioning member 500 itself can be positioned with respect to the metal shell 50, the positioning member 500 is provided with, on the rear side in the direction in which it is inserted into the metal shell 50, a stepped seat 510 that is to be brought into contact with the tip face 57 of the metal shell 50. The seat 510 has a cut portion 530 which extends parallel with the axial direction. The ground electrode 30 which is joined to the metal shell 50 engages the cut portion 530, whereby the direction of deviation between the axis of the cylindrical shape of the outer circumferential surface 501 and the axis of the cylindrical shape of the inner circumferential surface 502 is made equal to that between the axial line P of the crimped metal shell 50 and the axial line O of the insulator 10.

As the above-configured positioning member 500 is inserted into the metal shell 50 from its tip side, the outer circumferential surface 501 engages the inner circumferential surface 58 of the metal shell 50 while the ground electrode 30 engages the cut portion 530 of the seat 510. In this state, the packing 80 and the insulator 10 are inserted from the rear side of the metal shell 50, and the tip-side portion of the outer circumferential surface 14 of the insulator 10 engages the inner circumferential surface 502 of the through-hole 520 of the positioning member 500. After the ring members 6 and 7 and the talc powder 9 are put in place, the crimping portion 53 of the metal shell 50 is crimped, whereby the metal shell 50 and the insulator 10 are fixed to and integrated with one another. In this manner, the spark plug 100 in which the axial line P of the metal shell 50 and the axial line O of the insulator 10 deviate from one another and in which the relationship A>B is satisfied can be manufactured easily.

Where, as described above, the metal shell 50 is fixed to the insulator 10 in an off-axis state, internal stress might occur in the insulator 10 so as to be unsymmetrical with respect to the axial line O. In the embodiment, since the insulator 10 is supported via the packing 80, the talc powder 9, and the ring members 6 and 7 in the metal shell 50, such internal stress is absorbed by these members and therefore does not occur. Based on results of an evaluation test described below, the positional relationship between the metal shell 50 and the insulator 10 which are fixed to one another in the above-described manner is desirably such that the difference between the distances A and B each is 0.1 to 0.3 mm. For the same reason, the distance between the axial line O of the insulator 10 and the axial line P of the metal shell 50 is preferably from 0.05 mm to 0.15 mm on a plane including the tip face 57 of the metal shell 50.

The ground electrode 30 is joined to the tip face 57 of the metal shell 50 by resistance welding and a welding burr is produced at that time. Usually, the welding burr is cut away in a step that follows the resistance welding step. Where, as shown in FIG. 5, the welding burr is not removed completely (i.e., not removed to such an extent as to produce a smooth surface that is flush with the inner circumferential surface 58 of the metal shell 50), the welding burr may be left in the form of a welding projection 85 such that its length (represented by G in the figure) of projection from the inner circle L of the tip face 57 of the metal shell 50 toward the center of the circle L (i.e., the position of the axial line P) in the X-X plane is shorter than or equal to 0.1 mm. As long as the projection length G of the welding projection 85 is shorter than or equal to 0.1 mm, a clearance as required in the embodiment in order to arrange the metal shell 50 and the insulator 10 so that their axial lines P and O deviate from one another can be secured. If the projection length G of the welding projection 85 is greater than 0.1 mm, a spark discharge may occur between the tip portion of the welding projection 85 and the outer circumferential surface 14 of the insulator 10 when smoldering has occurred. The distance between the tip of the welding projection 85 and the outer circumferential surface 14 of the insulator 10 on the above-mentioned line Y-Y is represented by D. The distance D is desirably greater than the distance B, more specifically, the difference between the distances D and B is desirably from 0.1 to 0.3 mm.

Since, as described above, the transverse cross section of the ground electrode 30 is approximately rectangular, its adjoining side surfaces form a ridge line. In general, the electric field strength tends to be high around such sharp edges. In view of this, in the embodiment, to lower the influence, on a lateral spark, of electric field concentration around the ridge lines formed by the two respective longitudinal end lines of the side surface that is opposed to the axial line P (i.e., the inside surface 33) among the four side surfaces of the ground electrode 30, the positional relationship between the metal shell 50 and the insulator 10 is determined in the following manner.

First, as shown in FIG. 6, in the plane including the tip face 57 of the metal shell 50 (i.e., the above-mentioned X-X plane), the two end points of the inside line segment closest to the axial line P of the metal shell 50 among the four line segments that form the outline of the end face 35 of the base portion 32 of the ground electrode 30 are denoted by S1 and S2. The inside end points S1 and S2 are points obtained by projecting, onto the X-X plane, the two ridge lines formed by the inside surface 33 and the two adjacent side surfaces of the ground electrode 30, and are points where electric field concentration tends to occur. Next, the two straight lines passing through the two inside end points S1 and S2 and the center of the inner circle L of the tip face 57 of the metal shell 50 (i.e., the position of the axial line P on the X-X plane) are denoted by T1 and T2, respectively. The region inside the inner circle L of the tip face 57 of the metal shell 50 is divided into four sectors by the straight lines T1 and T2. The acute-angled sector that is defined by the straight lines T1 and T2 and part of the inner circle L, and which is located on the side of the position of the axial line P opposite the ground electrode 30, is denoted by U (hatched in FIG. 6). In the embodiment, the positional relationship between the metal shell 50 and the insulator 10 is determined so that the position of the axial line O (i.e., the intersection point of the axial line O and the X-X plane) is located in the acute-angled sector of the region L in the X-X plane.

The influence of electric field concentration around the inside end points S1 and S2 is relatively great on the side where the position of the axial line O of the insulator 10 is close to the inside end points S1 and S2 in the one, more distant from the ground electrode 30, of the two regions formed by dividing the inner circle L of the tip face 57 of the metal shell 50 by the straight line that passes through the position of the axial line P of the metal shell 50 and is perpendicular to the line Y-Y. For example, as shown in FIG. 7, the difference in distance between the position of the axial line O and the inside end point S1 and the distance between the position of the axial line O and the inside end point S2 increases as the position of the axial line O moves in a direction perpendicular to the line Y-Y so as to come closer to one of the inside end points S1 and S2. Therefore, the influence of electric field concentration around the closer one of the inside end points S1 and S2 can be decreased as the position of the axial line O comes closer, in the direction perpendicular to the line Y-Y, to the position where the distances between the position of the axial line O and the inside end points S1 and S2 are the same.

On the other hand, the influence of electric field concentration around the inside end points S1 and S2 is relatively small on the side where the position of the axial line O is away from the inside end points S1 and S2 in the one, more distant from the ground electrode 30, of the two regions formed by dividing the inner circle L of the tip face 57 of the metal shell 50 by the straight line that passes through the position of the axial line P of the metal shell 50 and is perpendicular to the line Y-Y. The difference in distance between the position of the axial line O and the inside end point S1 and the distance between the position of the axial line O and the inside end point S2 does not vary to a large extent even if the position of the axial line O moves in the direction perpendicular to the line Y-Y so as to come closer to one of the inside end points S1 and S2. For example, as shown in FIG. 8, a state in which the position of the axial line O deviates in the direction perpendicular to the line Y-Y so as to be located outside the range whose length is equal to the distance between the inside end points S1 and S2 is not preferred. This is because the distance between the inner circumferential surface 58 of the metal shell 50 and the outer circumferential surface 14 of the insulator 10 is small on the side of the deviation.

Based on the above discussion, as shown in FIG. 6, on the side where the position of the axial line O of the insulator 10 is close to the inside end points S1 and S2 in the one, more distant from the ground electrode 30, of the two regions formed by dividing the inner circle L of the tip face 57 of the metal shell 50 by the straight line that passes through the position of the axial line P of the metal shell 50 and is perpendicular to the line Y-Y, the position of the axial line O is set at a position where the distances between the position of the axial line O and the inside end points S1 and S2 are approximately the same even if it deviates in the direction perpendicular to the line Y-Y. On the side where the position of the axial line O of the insulator 10 is away from the inside end points S1 and S2 in the one, more distant from the ground electrode 30, of the two regions formed by dividing the inner circle L of the tip face 57 of the metal shell 50 by the straight line that passes through the position of the axial line P of the metal shell 50 and is perpendicular to the line Y-Y, the position of the axial line O is allowed to deviate in the direction perpendicular to the line Y-Y as long as it is located within a range whose length is equal to the distance between the inside end points S1 and S2. That is, determining the position of the axial line O of the insulator 10 so that it is located in the above-mentioned acute-angled sector U makes the spark plug 100 less prone to the influence of electric field concentration around the inside end points S1 and S2 and hence prevents lateral sparking. This is the case even if positioning tolerance between the axial line P of the metal shell 50 and the axial line O of the insulator 10 in manufacture of the spark plug 100 is set large.

In the spark plug 100 according to the embodiment, the noble metal chip 91 is joined to the part of the inside surface 33 corresponding to the tip portion 31 of the ground electrode 30. In the completed spark plug 100, the noble metal chip 91 joined to the ground electrode 30 and the noble metal chip 90 joined to the tip portion 22 of the center electrode 20 are desirably opposed to one another as shown in FIG. 2. An appropriate measure for this purpose is to adjust the joining position of the noble metal chip 91 on the inside surface 33 of the ground electrode 30 in accordance with the deviation between the axial line P of the metal shell 50 and the axial line O of the insulator 10 when the noble metal chip 91 is joined to the ground electrode 30. More specifically, it is appropriate to join the noble metal chip 91 at a position that deviates toward the tip of the ground electrode 30 from the joining position (reference joining position) of the noble metal chip on the ground electrode in a conventional spark plug (i.e., the joining position with which the axial line of the noble metal chip coincides with the axial line P of the metal shell when the ground electrode is bent) by the deviation between the axial lines P and O (i.e., (A−B)/2 (see FIG. 3)).

EXAMPLES

The following evaluation test was performed on the above-configured spark plug 100 to confirm the advantages of the invention.

Example 1

In this evaluation test, eight samples of the spark plug 100 were manufactured in which the deviation of the axial line O of the insulator 10 from the axial line P of the metal shell 50 (the off-axis deviation) was varied in a range of −0.3 to +0.4 mm with a step of 0.1 mm, and the probability of occurrence of a lateral spark was measured for each sample. The off-axis deviation was defined as the distance between the position of the axial line P and the position of the axial line O on the line Y-Y in the cross section of the spark plug 100 shown in FIG. 3. The polarity of the off-axis deviation was defined such that the off-axis deviation is indicated as negative when the position of the axial line O is located on the side of the position of the axial line P where the ground electrode 30 is joined to the metal shell 50, and is indicated as positive when the position of the axial line O is located on the opposite side.

The spark plug samples conformed to a specification in which the nominal designation of the screw portion 52 of the metal shell 50 was M10 (the clearance between the outer circumferential surface 14 of the insulator 10 and the inner circumferential surface 58 of the metal shell 50 was 1.5 mm when their axial lines O and P coincide with one another). Each sample was rendered in a smoldered state by adhering carbon on the tip portion of the insulator 10 of each sample. Each sample was placed in a chamber, and spark discharges were generated 100 times at an air pressure of 0.6 MPa. The number of times that a lateral spark occurred was measured during that course, and the probability of occurrence of a lateral spark was thereby obtained. The spark discharge gap of each sample was set at 0.9 mm.

Figure 9:
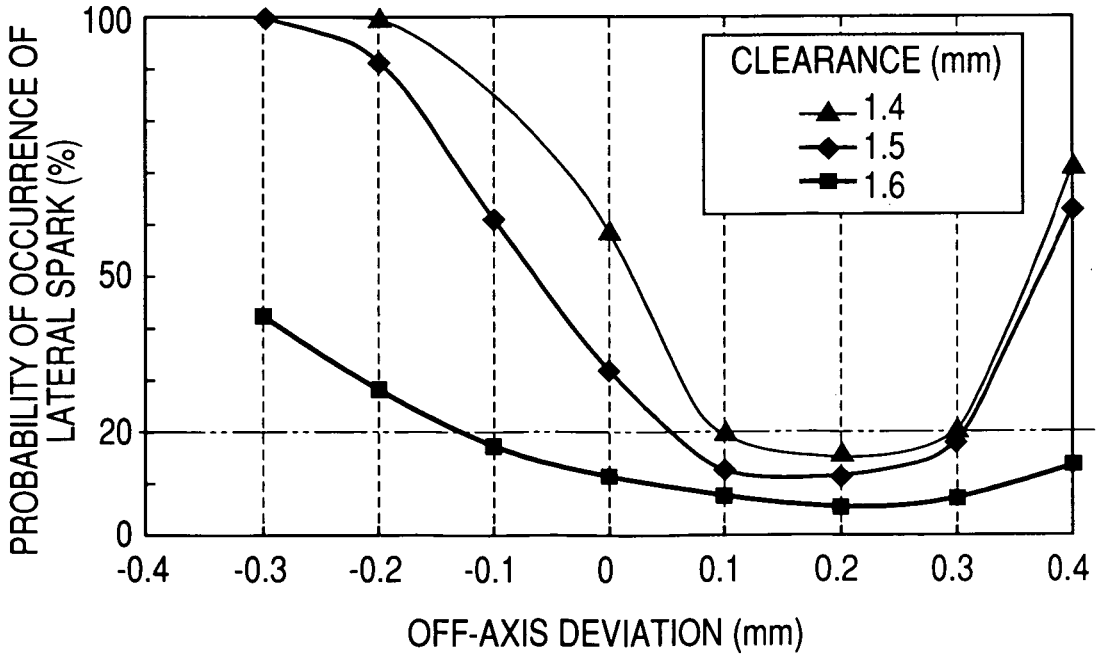
FIG. 9 is a graph showing a relationship between off-axis deviation and the probability of occurrence of lateral sparking.

As shown in FIG. 9, in the case of a spark plug sample in which the off-axis deviation was 0 mm, that is, when the axial line P of the metal shell 50 and the axial line O of the insulator 10 are coincident, the probability of occurrence of lateral sparking was 30% to 40%. As the off-axis deviation was increased in the negative direction, that is, when the axial line O of the insulator 10 was moved closer to the ground electrode 30, the distance A (see FIG. 3) decreased and hence the probability of occurrence of lateral sparking increased. The probability of lateral sparking reached 100% when the off-axis deviation was −0.3 mm. On the other hand, as the off-axis deviation increased in the positive direction, that is, when the axial line O of the insulator 10 was moved away from the ground electrode 30, the distance A (see FIG. 3) increased and hence the probability of lateral sparking decreased. However, when the off-axis deviation was further increased, the distance B (see FIG. 3) became excessively small and hence lateral sparking occurred on the side opposite the ground electrode 30 in the X-X plane (see FIG. 2) to increase the probability of lateral sparking. More specifically, it was found that if the off-axis deviation was +0.1 to +0.3 mm, the probability of lateral sparking was lower than or equal to 20% and therefore suitable for manufactured products.

In the above evaluation test, samples in which the nominal designation of the screw portion 52 was M10 and the clearance was 1.4 mm and samples in which the nominal designation of the screw portion 52 was M12 and the clearance was 1.6 mm were prepared as comparative examples and were subjected to the same test. It was found that in either group of samples the probability of lateral sparking was lower than or equal to 20% and therefore suitable for manufactured products as long as the off-axis deviation was +0.1 to +0.3 mm.

When a spark discharge occurs, the electric field strength around the ground electrode increases and hence the dielectric breakdown voltage between the ground-electrode-side portion of the inner circumferential surface of the metal shell and the outer circumferential surface of the insulator becomes low. However, as described in Example 1, it was found that the dielectric breakdown voltage between the inner circumferential surface 58 of the metal shell 50 and the outer circumferential surface 14 of the insulator 10 can be made uniform over the entire circumference thereof, and lateral sparking can be prevented by deviating the axial line O of the insulator 10 from the axial line P of the metal shell 10 toward the side opposite the ground electrode 30.

Figure 10:
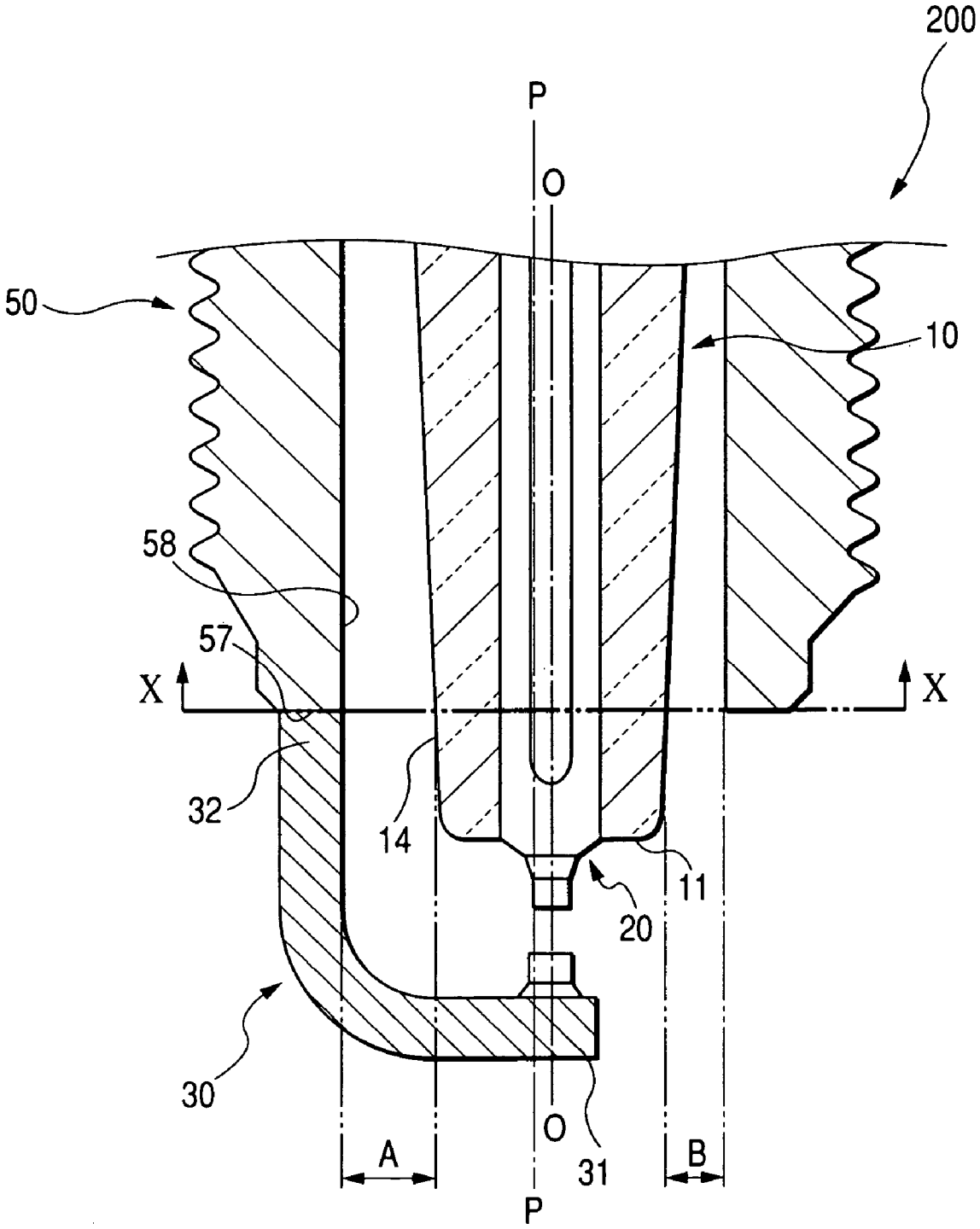
FIG. 10 is an enlarged sectional view of part of a spark plug 200, in which the insulator 10 and the metal shell 50 are integrated and where the axial line O of the insulator 10 is inclined from the axial line P of the metal shell 50.

It goes without saying that various modifications of the invention are possible. For example, although in the embodiment the positional relationship between the axial line P of the metal shell 50 and the axial line O of the insulator 10 is changed while the axial lines P and O are kept parallel with each other, it may be changed by inclining the axial line O from the axial line P. For example, in the spark plug 200 shown in FIG. 10, the metal shell 50 and the insulator 10 are integrated by crimping the crimping portion 53 so as to tentatively fix the same, with axial lines P and O arranged so as not to be parallel with one another. In this case, the metal shell 50 and the insulator 10 may be tentatively fixed to one another so that, as in the embodiment, the distance A (between the outer circumferential surface 14 of the insulator 10 and the inner circle L of the tip face 57 of the metal shell 50 on the ground electrode 30 side of the axial line P) is longer than the distance B (between the outer circumferential surface 14 of the insulator 10 and the inner circle L of the tip face 57 of the metal shell 50 on the side of the axial line P opposite the ground electrode 30 in the X-X plane which includes the tip face 57 of the metal shell 50).

Figure 11:
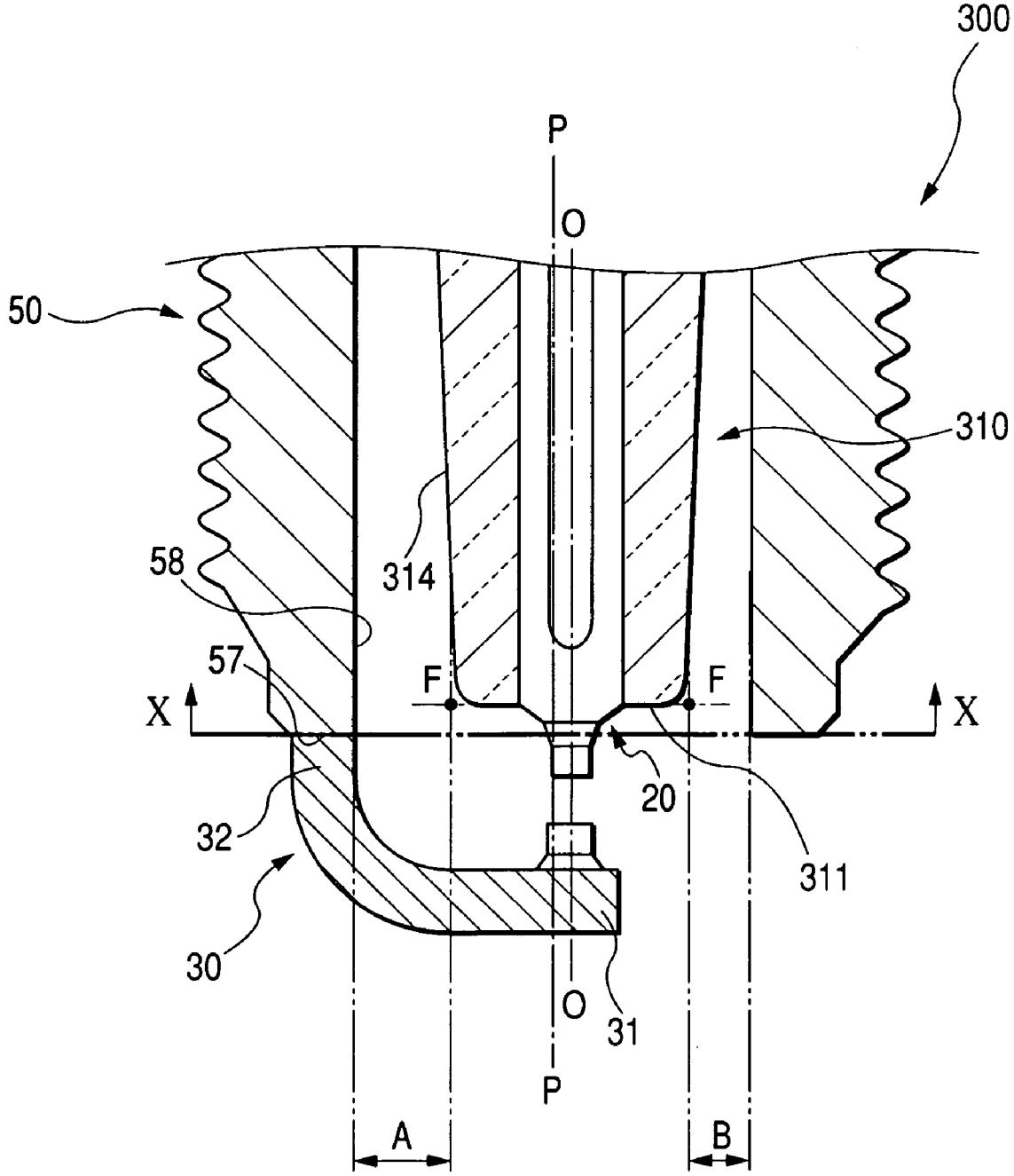
FIG. 11 is an enlarged sectional view of part of a spark plug 300, in which a tip face 311 of an insulator 310 is located behind a tip face 57 of the metal shell 50.

As another example, in the spark plug 300 shown in FIG. 11, a tip face 311 of an insulator 310 may be located behind the tip face 57 of the metal shall 50. In this case, the following procedure may be employed. Assume an imaginary circle that is an intersection line F formed by a curved plane extended from a tip-side outer circumferential surface 314 of the insulator 310 and a plane including the tip face 311 of the insulator 310. The distances A and B as used in the embodiment herein are defined as the distances between an imaginary circle obtained by projecting the above imaginary circle onto the X-X plane including the tip face 57 of the metal shell 50 and the inner circle of the tip face 57 of the metal shell 50. The insulator 310 is fixed to the metal shell 50 so that the distance A is longer than the distance B.

Further, a ridge line 59 (see FIG. 2) formed by the tip face 57 and the inner circumferential surface 58 of the metal shell 50 may be subjected to chamfering. For example, in the spark plug 400 shown in FIG. 12, a chamfered portion 459 is formed between a tip face 457 and an inner circumferential surface 458 of a metal shell 450. As mentioned above, the electric field strength tends to be high around such sharp edges and a spark discharge is prone to occur there. Therefore, the probability of occurrence of a lateral spark can be reduced by chamfering the ridge line formed by the tip face 457 and the inner circumferential surface 458 to thereby eliminate the sharp edge. In this case, even if a welding burr is produced in the chamfered portion 459 in resistance-welding the ground electrode 30 to the metal shell 450, it is located outside the inner circumferential surface 458 of the metal shell 450 and does not project inward from the inner circumferential surface 458.

Figure 12:
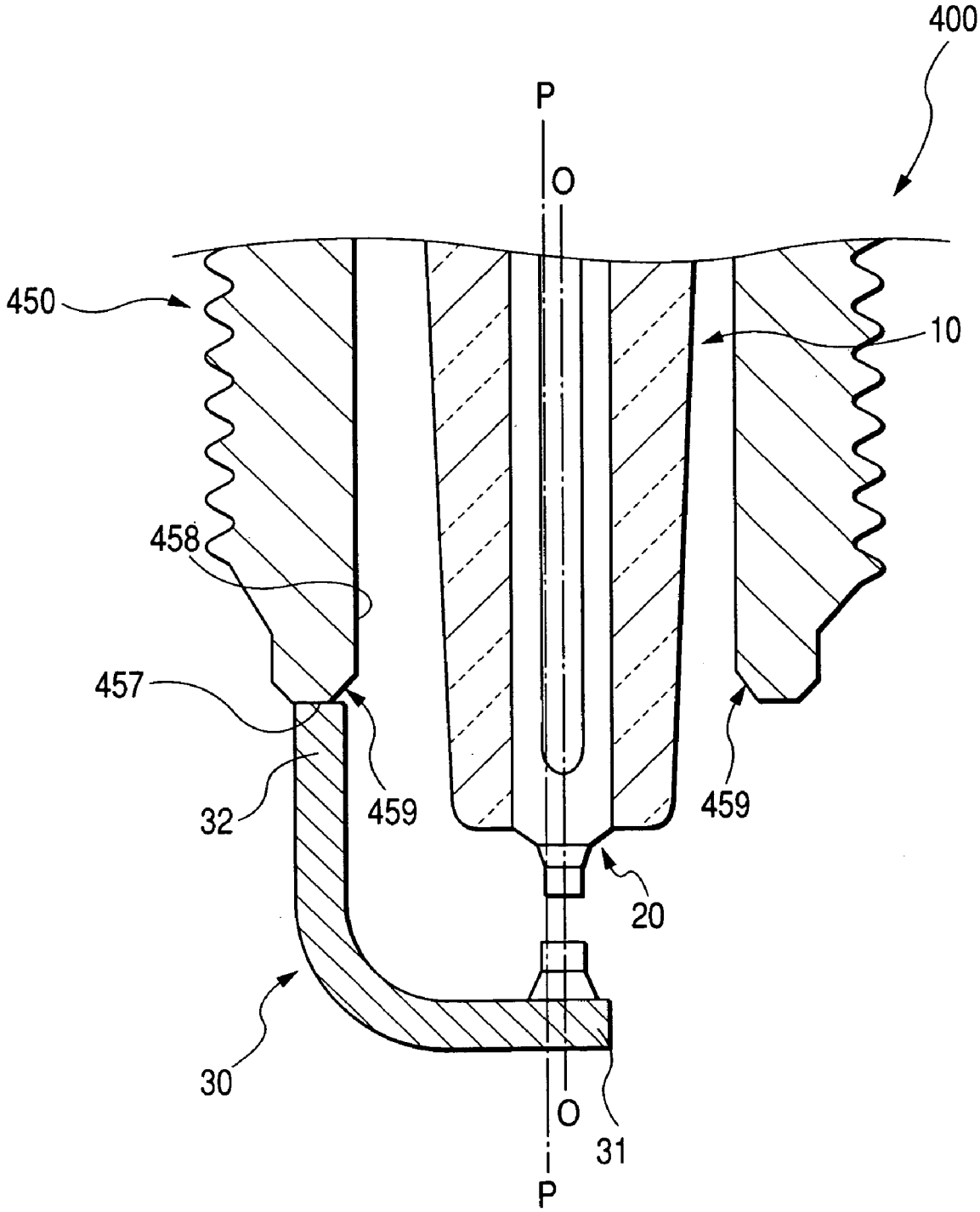
FIG. 12 is an enlarged sectional view of part of a spark plug 400, in which a ridge line formed by a tip face 457 and an inner circumferential surface 458 of a metal shell 450 is subjected to C chamfering.
Figure 13:
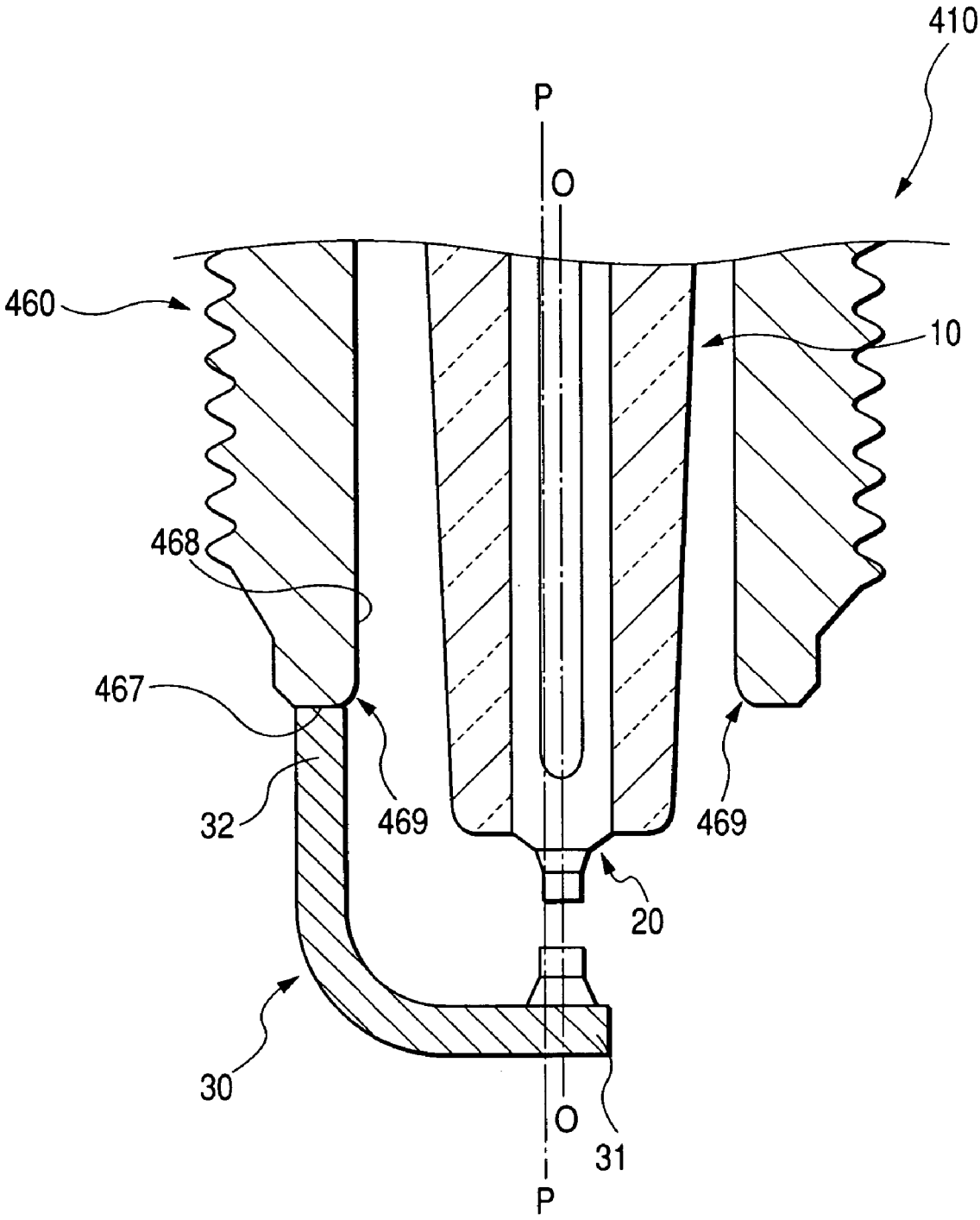
FIG. 13 is an enlarged sectional view of part of a spark plug 410, in which a ridge line formed by a tip face 467 and an inner circumferential surface 468 of a metal shell 460 is subjected to R chamfering.

The spark plug 400 of FIG. 12 is such that the chamfered portion 459 is formed by C chamfering. The same advantage can be obtained by performing R chamfering on a ridge line formed by a tip face 467 and an inner circumferential surface 468 of a metal shell 460 to produce a chamfered portion 469 of a spark plug 410 shown in FIG. 13 or by performing tapered chamfering (not shown). The term "tapered chamfering" means that the corner defined by two planes is chamfered so that the angles between the chamfer plane and the two planes defining the corner are not limited to 45° respectively (for example, angles of 30° and 60° are allowed). This is in contrast to the C chamfering where the angles between the chamfer plane and the two planes defining the corner each are about 45°. For the purpose of preventing electric field concentration around the ridge line 59 (see FIG. 2) formed by the tip face 57 and the inner circumferential surface 58 of the metal shell 50, the chamfered portion 459 shown in FIG. 12 produced by C chamfering is preferably C0.1 or larger in size, and the chamfered portion 469 shown in FIG. 13 produced by R chamfering is preferably R0.1 or larger in size.

Where chamfering is performed, it is not necessary to make the center-electrode-20-side surface of the ground electrode 30 flush with the inner circumferential surface 458 or 468 of the metal shell 450 or 460 in the sectional views of FIG. 11 or 12. That is, the ridge line formed by the end face of the base portion 32 of the ground electrode 30 and the center-electrode-20-side surface of the ground electrode 30 may face the chamfered portion 459 or 469 as shown in FIG. 12 or 13. However, if the spark plug 400 or 410 is constructed so that the ridge line faces the post-chamfering tip face 457 or 467 rather than the chamfered portion 459 or 469, the electric field concentration around the ridge line can be prevented.

Figure 14:
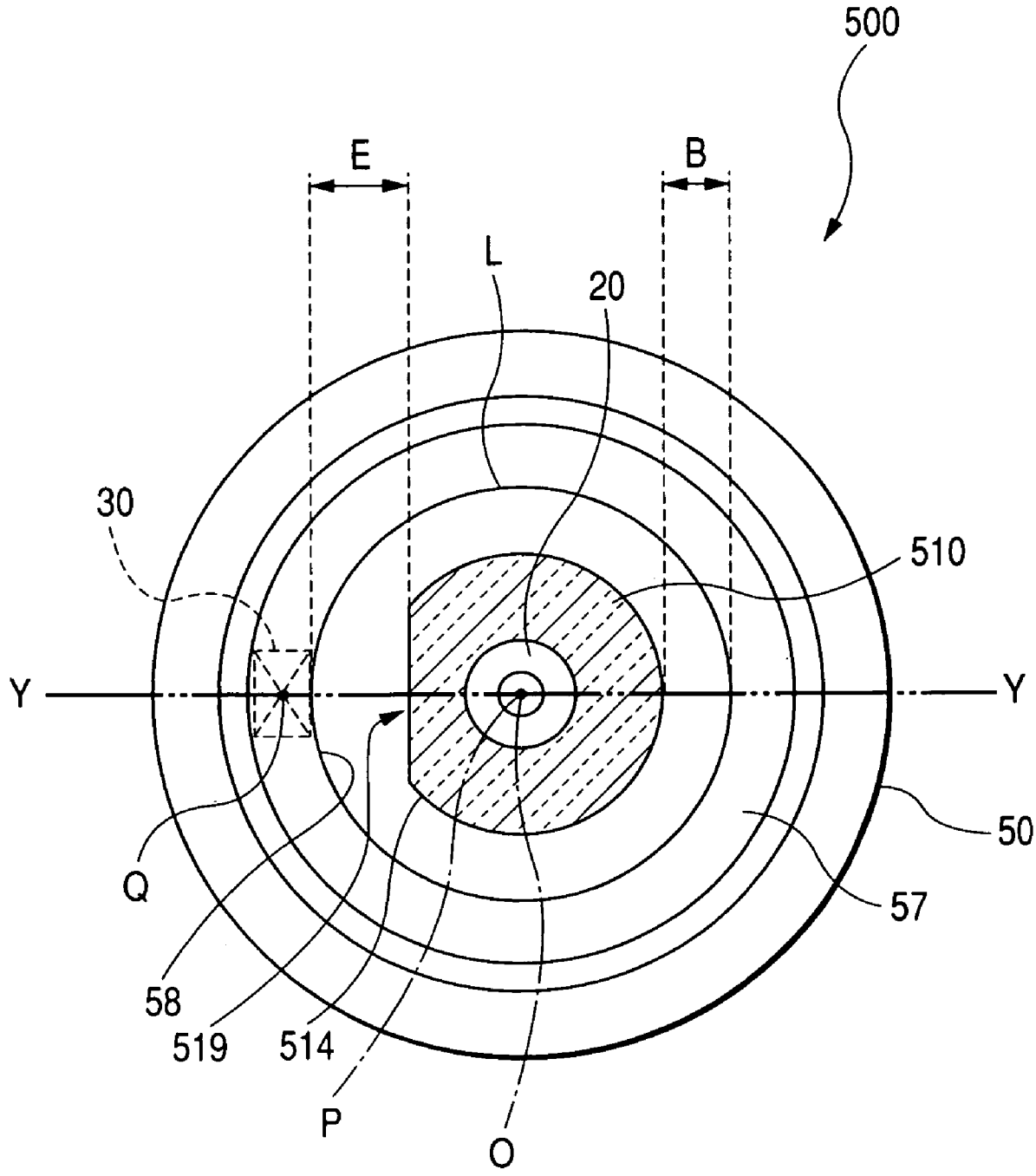
FIG. 14 is a sectional view of a tip portion of a spark plug 500, in which a tip portion of an insulator 510 has a thin portion which is located on the side of the ground electrode 30.

The cross section of the insulator 10 taken perpendicularly to the axial line O need not be a perfect circle. For example, in the spark plug 500 shown in FIG. 14, a tip portion of an insulator 510 has a thin portion 519 which is located on the side of the ground electrode 30. With the thus-configured insulator 510, the insulator 510 and the metal shell 50 can be assembled so that the axial line O of the insulator 510 coincides with the axial line P of the metal shell 50. Now, let E represent the distance between the inner circle L of the tip face 57 of the metal shell 50 and the thin portion 519 of the insulator 510 on the line Y-Y passing through the center Q of the ground electrode 30 and the axial line P of the metal shell 50 in the X-X plane including the tip face 57 of the metal shell 50. The spark plug 500 may be constructed so that the distance E is longer than the distance B as mentioned in the embodiment. However, with such an insulator 510, the durability or the insulation performance may lower due to the thin portion, etc. Therefore, as in the embodiment, the axial line of the insulator is arranged so as to deviate from that of the metal shell.

The invention can be applied to spark plugs for internal combustion engines.

It should further be apparent to those skilled in the art that various changes in form and detail of the invention as shown and described above may be made. It is intended that such changes be included within the spirit and scope of the claims appended hereto.

This application is based on Japanese Patent application JP 2005-63747, filed Mar. 8, 2005, the entire content of which is hereby incorporated by reference, the same as if set forth at length.

What is claimed is:

1. A spark plug comprising: a center electrode; an insulator having an axial hole extending in an axial direction of the center electrode and holding the center electrode in the axial hole; a cylindrical metal shell surrounding the insulator, and a ground electrode having first and second end portions, an end face of one end portion being joined to a tip face of the metal shell and the other end portion being opposed to the center electrode, wherein an axial line of the metal shell and an axial line of the insulator deviate from one another so that a relationship A>B is satisfied for distances A and B which are defined on a line connecting the center of an inner circle of the tip face of the metal shell and the center of the end face of the one end portion of the ground electrode, where:

the distance A is defined as a distance on the side of the ground electrode between the inner circle of the tip face of the metal shell and an intersection line of an outer circumferential surface of the insulator and a plane including the tip face of the metal shell or a projection, onto the plane, of an intersection line of an extended surface of the outer circumferential surface of the insulator and a plane including a tip face of the insulator; and the distance B is defined as a distance on a side opposite the ground electrode between the inner circle of the tip face of the metal shell and the intersection line of the outer circumferential surface of the insulator and the plane including the tip face of the metal shell or the projection, onto the plane, of the intersection line of the extended surface of the outer circumferential surface of the insulator and the plane including the tip face of the insulator, wherein a distance between the inner circle of the tip face of the metal shell and the intersection line of the outer circumferential surface of the insulator and the plane including the tip face of the metal shell or the projection, onto the plane, of the intersection line of the extended surface of the outer circumferential surface of the insulator and the plane including the tip face of the insulator is shorter than or equal to 1.5 mm.

2. The spark plug as claimed in claim 1, wherein:

the metal shell has, as an outer circumferential portion, a screw portion having a nominal diameter which is smaller than or equal to that of M12;

and the axial line of the metal shell and the axial line of the insulator deviate from one another so that a relationship 0.1 mm $\leqq$A-B $\leqq$0.3 mm is satisfied.

3. The spark plug as claimed in claim 1, wherein the axial line of the metal shell and the axial line of the insulator deviate from one another so that a relationship 0.1 mm $\leqq$A-B $\leqq$0.3 mm is satisfied.

4. The spark plug as claimed in claim 1, comprising a C-chamfered portion of C0.1 or larger or an R-chamfered portion of R0.1 or larger formed at a ridge line defined by the tip face and an inner circumferential surface of the metal shell.

5. The spark plug as claimed in claim 1, wherein the ground electrode is joined to the tip face of the metal shell by welding and a length of projection, toward the center of the inner circle of the tip face of the metal shell, of a welding projection formed by the welding so as to bridge the ground electrode and the metal shell is made shorter than or equal to 0.1 mm.

6. A spark plug comprising: a center electrode; an insulator having an axial hole extending in an axial direction of the center electrode and holding the center electrode in the axial hole; a cylindrical metal shell surrounding the insulator; and a ground electrode having first and second end portions, an end face of one end portion being joined to a tip face of the metal shell and the other end portion being opposed to the center electrode, wherein an axial line of the insulator deviates from an axial line of the metal shell to a side opposite of the one end portion of the ground electrode, and wherein a distance between the axial line of the insulator and the axial line of the metal shell is from 0.05 mm to 0.15 mm on a plane including the tip face of the metal shell, and wherein a distance between an inner circle of the tip face of the metal shell and an intersection line of an outer circumferential surface of the insulator and a plane including the tip face of the metal shell or a projection, onto the plane, of an intersection line of an extended surface of the outer circumferential surface of the insulator and a plane including the tip face of the insulator is shorter than or equal to 1.5 mm.

* * * * *